United States Patent [19]

McDermott

[11] Patent Number: 4,947,291

[45] Date of Patent: Aug. 7, 1990

[54] LIGHTING DEVICE

[76] Inventor: Kevin McDermott, 196 Phillips Dr., Hampstead, Md. 21074

[21] Appl. No.: 208,218

[22] Filed: Jun. 17, 1988

[51] Int. Cl.[5] ..... F21V 9/00

[52] U.S. Cl. ..... 362/19; 362/293; 362/800; 362/295; 362/231; 350/407

[58] Field of Search ..... 362/19, 231, 242, 282, 362/283, 323, 293, 800, 294, 34, 84, 228, 295, 394, 268, 251, 240, 252, 184, 202, 205; 350/407; 200/60

[56] References Cited

U.S. PATENT DOCUMENTS

| | | | |
|---|---|---|---|
| 3,936,147 | 2/1976 | Murakami | 350/407 X |
| 4,202,601 | 5/1980 | Burbo et al. | 350/407 |
| 4,517,628 | 5/1985 | McDermott | 362/186 |
| 4,580,196 | 4/1986 | Task | 362/800 X |
| 4,623,959 | 11/1986 | Ostermann | 362/293 |
| 4,677,533 | 6/1987 | McDermott et al. | 362/240 |
| 4,697,890 | 10/1987 | Crookston | 350/407 |
| 4,722,028 | 1/1988 | Brannon et al. | 362/231 X |

*Primary Examiner*—Ira S. Lazarus
*Assistant Examiner*—D. M. Cox
*Attorney, Agent, or Firm*—Eugene F. Osborne, Sr.

[57] ABSTRACT

A synthesizer for covert operations under blackout conditions of a light that has shaped energy distributions in the visible wavelengths for visual discrimination of multiple colors upon objects in the user's view and comparative energy suppression in the infrared and certain selected visible wavelengths for reducing the likelihood of detection by external hostile forces having night image intensifiers and for preventing the saturation failure of the user's own image intensifier or those of nearby friendly forces plus apparatus for proportional dimming of the emitted light for observers using the naked eye and observers using image intensifiers.

25 Claims, 3 Drawing Sheets

LIGHTING DEVICE

BACKGROUND OF THE INVENTION

1. Field of the Invention

This invention relates to a lighting device which is used to illuminate during military blackout applications and also in conjunction with night vision goggles. The preferred embodiment relates to a flashlight, however, the invention is not limited to that use as it will also find application in permanently mounted fixtures and with power sources other than batteries.

2. Related Art

For the past 40 years, the military has employed red light in those instances when blackout security was required Blackout situations required personnel to substantially reduce their detectability while still permitting them to carry out their assigned tasks Some of these assigned tasks such as the reading of colored maps, required color discrimination while others such as piloting aircraft required extremely sensitive eyesight It was known that the use of red light created problems in color discrimination. However, this defect was accepted because the red light did not substantially impair the ability of the soldiers to detect low levels of light, i.e., the red color did not reduce the peripheral retinal sensitivity of the eye.

During the past ten years the military has been developing and using night vision goggles. These goggles permit users to see in the dark by amplifying the incoming radiation in the visible and near infrared range up to 40,000 times. As these goggles became more widely used, it was found that the red lighting system in use was not compatible with the goggles. The red light prevented the goggles from functioning properly by overwhelming them with ambient red and infrared energy.

Many of the military applications are now using a blue/green color, Anvis Green A, for their blackout lighting operations. The ANVIS GREEN colors are defined in Military Specification, MIL-L-85762, LIGHTING, AIRCRAFT, INTERIOR, AN/ANV-6 AVIATOR'S NIGHT VISION IMAGING SYSTEM (ANVIS) COMPATIBLE, 24 Jan. 1986. The switch to the new blue/green color was made only after extensive testing showed that this color would, like the red, have minimal effect on the peripheral retinal sensitivity of the eye and simultaneously it would not interfere with the use of night vision goggles.

However, for blackout conditions the blue/green color has the same defect as the red color in that it fails to accurately reveal for the user the full range of colors that may be found on military maps or as are present in the military work place.

The concept that blackout lighting had to be colored has been a long established military concept which is still in use today. There are numerous pieces of military equipment which are in use based upon the concept that color lighting was necessary for blackout situations. One such piece of equipment is a portable lighting device described in U.S. Pat. No. 4,517,628, which permits the color to be changed from incandescent white to red for blackout conditions. Therefore, prior art and long established convention both dictate that unfiltered incandescent white light cannot be successfully used for illumination under blackout conditions. Portions of this invention use prior art U.S. Pat. No. 4,677,533, which relates to a lighting device intended for color discrimination but not designed for blackout lighting or use near night vision goggles.

SUMMARY OF THE INVENTION

The lighting device of the present invention is a projector of light with radiant energy concentrated in the visible wavelengths and with spectral distributions tailored for example, for full color discrimination by personnel having normal eye sensitivities and characteristics or tailored for minimum exposure of the covert user to the possibility of his detection when using the lighting device under night blackout conditions. For many applications the preferred embodiment provides a "white" light with controls for the adjustment or dimming of the brilliance of the projected light. The lighting device is implemented in a portable flashlight, in cockpit lighting, and in fixed area lighting models.

The present invention encompasses a system for the enhancement of vision under battlefield blackout conditions in conjunction with the use of image intensifiers, commonly called "night vision goggles" by friendly as well as enemy forces.

The present invention comprises either an electronic light source which emits only a small amount of near infrared radiation or an incandescent light source having broad spectral energies with an infrared attenuating filter such that the combination emits only a small amount of infrared radiation. When used for multiple color discrimination the projected light should be white and may be synthesized by a combination of the radiations emitted from more than one source each possibly having its own spectral distribution.

This invention is a lighting device that can produce unlimited hues of colored lighting for tasks requiring specific color recognition such as the examination of human tissue or white light illumination for color discrimination of multi-colored surfaces such as maps. Furthermore, the invention can be used without degrading the performance of night vision goggles being used by nearby on site friendly personnel. It also reduces the possibility of hostile forces using their night vision goggles to locate the user of the flashlight. Also important is the feature that the flashlight appears off to the user only when it is off to the night vision goggles of hostile forces. This assures that the user will not mistakenly direct detectable energy towards the hostile forces believing the flashlight is totally off when it may continue to radiate energy in the infrared wavelengths.

The invention can also be a signal light because the on time when viewed by the naked eye is substantially equal to the on time when viewed by night vision goggles.

One object of this invention is to provide a flashlight for blackout conditions which projects essentially white light which is capable of illuminating colored maps and permitting an accurate recognition of the colors on those maps.

Another objective of the invention is to permit the reading of colored maps under lighting having spectral distributions of colors that exceed that radiance limits of the 1976 military ANVIS GREEN A color without seriously degrading the operation of nearby night vision goggles.

Another objective of the invention is to provide a flashlight which has the ability to be dimmed while still permitting the accurate reading of the colors on multicolored maps.

Another objective of the invention is to provide a flashlight which when dimmed provides reductions in intensities which are proportionally equal for those using the lighting device with the naked eye and those using night vision goggles.

Another object of this invention is to provide a flashlight which is designed so that when it appears off to the user's unaided eye it will simultaneously appear off to an observer using night vision goggles.

Another object of this invention is to provide a flashlight which, if energized for a short period of time, will appear to be on for essentially the same time span irrespective of whether the person observing the flashlight is using the unaided eye or is using night vision goggles.

Another object of this invention is to provide a flashlight which will prevent accidental reductions in available power from altering the projected radiation such that the light appears off to the unaided eye but on to an observer using night vision goggles.

Another object of this invention is to provide a flashlight which will reduce the possibility of its user being visible to hostile observers using night vision goggles in the event the housing of the flashlight should be damaged.

Another object of this invention is to provide a lighting device which minimizes the required visual radiation by projecting the bulk of its radiant energy within a bandwidth which includes the maximum relative luminous efficiency of the photopic eye.

A still further object of this invention is to provide a lighting device which when used will reduce the likelihood of detection of the user by distant hostile observers who may have night vision goggles or more advanced image intensifiers that are sensitive to radiant energy in the infra-red wavelengths.

BRIEF DESCRIPTION OF THE DRAWINGS

Other objects and advantages of the invention will become more apparent from a reading of the description in connection with the accompanying drawings of preferred embodiments, in which.

DETAILED DESCRIPTION OF THE INVENTION

Figure 1:
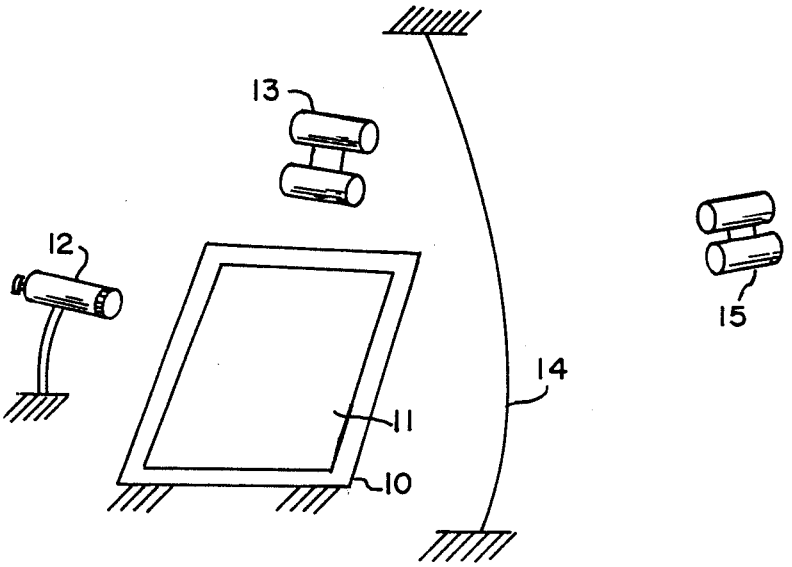
FIG. 1 is an illustration depicting a night vision scenario under blackout conditions

One facet of this invention resulted from the realization that if the blue/green and red colors are combined, they produce essentially white light Since extensive testing has shown that the components of the white light do not separately impair the sensitivity of the eyes' receptors the sum of these colors, white light itself, will also not impair the eyes' sensitivity. Furthermore, since the white light will require less blue/green than the pure blue/green light and less red than the pure red light it will be less likely to saturate either the blue, green or red type cone or the rod receptors located within the eye. Thus the white light is not only superior as far as retaining the eyes' sensitivity to the low levels of illumination but it also provides the ability to correctly read the colors on maps.

This invention includes a covertness requirement that the total radiant energy of the light emitted in the visible spectrum between the wavelengths of 380 and 740 nanometers be at least 10 times the total radiant energy projected between the wavelengths of 740 and 950 nanometers. This feature used with other facets of the invention provides a flashlight which is uniquely suited for use in a blackout/night vision goggle environment. It alone permits the adjacent successful use of night vision goggles and the accurate recognition of multiple colors while maintaining its users security from hostile observers.

The combined color discrimination requirement of the user and the covertness requirement to reduce the likelihood of detection of the user by hostile enemy forces also having image intensifiers necessitates a spectral distribution requirement within the visible wavelengths of 380 to 740 nanometers. The term "white light" as used in this disclosure refers to a visible light which when projected on a multicolored surface provides accurate color reflections and permits accurate color perception by the eye and human sense of sight for most of the colors of the spectrum such as the principal colors of red, yellow, and blue. A "white light" comprises energies distributed in a broad band of spectral wavelengths, whereas a single color as emitted typically, by light emitted diodes (LEDS), comprises energies distributed in a narrow band of spectral wavelengths of less than 55 nanometers at the 50 percent response relative to peak energy, according to manufactuer's data.

Where full color recognition is not required the covertness of the user may be improved by matching the spectral energies of the lighting device to the sensitivity response curve of the photopic eye and by reducing or dimming the projected light intensity while retaining the user's ability to recognize information. As specific examples:

For a first application, the total spectral radiant energy projected in the wavelengths between 380 and 510 nanometers is between 3 and 40 percent of the total spectral radiant energy projected between 380 and 740 nanometers, and the total spectral radiant energy projected between 600 and 740 nanometers is at least 20 percent of the total spectral radiant energy projected between 380 and 740 nanometers.

For a second application, the total spectral radiant energy projected in the visible wavelengths between 380 and 740 nanometers is concentrated so as to yield at least 80 percent of the total visible energy within the narrow band of wavelengths between 525 and 625 nanometers for superior luminous efficiency of the unaided photopic eye.

This invention will proportionately dim for those viewing the light with the naked eye and with night vision goggles. Prior to this invention, the dimming of incandescent bulbs by electrical means lowered their filament temperature and shifted a greater portion of their emitted broad spectral radiant energy from the visible to the infrared spectrum This dimming when viewed by a user with his naked eye would be far more than the dimming effect as viewed by a person using night vision goggles The invention corrects this deficiency by severely limiting the percentage of infrared radiation through the means of optical filtering, source selection of lamps, and combinations thereof. Thus even in the embodiment of this invention using an incandescent lamp, the problem created because the percentage of emitted radiation in the infrared portion of the spectrum increases as the power to the lamp is decreased is ameliorated because the bulk of that energy is never projected from the lighting device in the first place. Electrical dimming of the incandescent lamp embodiment will continue to increase the percentage of infrared radiation projected from the invention but the fact that the infrared radiation is proportionally increasing is no longer a major factor in dimming because infrared energy is a small percentage of the total projected energy.

Other embodiments of this invention include a combination of the source of light with adjustable optical polarizing filters. Past experience with dimming devices such as polarizing filters has shown that the dimming effect created by crossing the planes of polarization of two polarizing filters in the visible spectrum is greater than the dimming created in the infrared spectrum. Thus a user using the lighting device with his naked eye would see more dimming than another user using the dimming device with night vision goggles. Even in the instance when the person using the night vision goggles is not himself using the invention, it is desirable that his night vision goggles respond similarly if the adjacent person using his naked eye reduces the visible energy through a dimming system.

By drastically limiting the percentage of infrared energy of the projected radiation this invention provides a lighting device which dims proportionately for the naked eye and night vision goggles. It does this because although the polarizing filters dim the infrared and visible wavelengths differently, this characteristic becomes unimportant due to the small percentage of infrared energy projected.

For the generation of a source of white light for covert operations having a low percentage of radiant infrared energy and the desired spectral distribution of energy within the visible wavelengths, the embodiments of the invention include, in addition to the filtered incandescent, the electroluminescent lamp, arrays of light emitting diodes of selected narrow band colors for synthesis of white light, and arrays of light emitting diodes in combination with a selected lamp. In this invention the term lamp is broadly conceived to include incandescent devices of all types, gas discharge devices such as the fluorescent or neon, high energy discharge types such as mercury lamps, chemical devices, light emitting diodes and electronic or electroluminescent devices. Current technology permits several light emitting diodes to be encapsulated within a single discrete package. In this instance the number of lamps for our purpose shall be considered the number of light emitting diodes regardless of the number of packages.

Now referring to the drawings, there is illustrated in FIG. 1 a night application scenario employing the improved lighting device. In the example, a user's work station 10 provides support for the colored map 11 which is illuminated by the light of the reading lamp 12. The user or an adjacent on-site friendly person views the external scene by means of the image intensifier 13 (referred to herein as night vision goggles) looking through the compartment window 14. In the external area one or more hostile persons also having night vision goggles 15 survey the scene to detect the presence and location of the user. The night vision goggles 13, 15 are sensitive to sources of radiant energy in the wavelengths between 380 and 950 nanometers. The user desires to read the information and any color features of the map without exposing his location to hostile forces and without interference or saturation of the night vision instruments he himself uses or that are in use by adjacent friendly persons on-site within the area. Other covert applications and scenarios are apparent A discussion of preferred embodiments follows.

A lighting device 16 for cockpit or established work station applications is illustrated by FIGS. 2–5. The lamp housing 17 has an extended hood 18 to restrict the field of illumination.

Electrical power is supplied by cable feeding in through the flexible mounting support 19. A conventional on-off switch and rheostat 20 is provided for electrical control and dimming. In a first lighting subassembly an incandescent bulb 21 is supported by bracket and base socket 22 and reflector 23 in the central aperture thereof an infrared attenuating filter 24 situated in the path of illumination from the incandescent bulb 21 to restrict the emitted light principally to the visible wavelengths between 380 and 740 nanometers. Distributed within a second lighting subassembly in the annular optical panel 24 are a multiplicity of preferred red and green light emitting diodes (LEDS) 25, arranged in alternating color sequence, although a single color or other colors may be used for desired spectral responses. The exit aperture of the lighting device 16 has included within the hood 18 thereof a 1st polarizing filter 27 and a rotatable assembly 29 having a 2nd polarizing filter 28 fixed thereto By rotation of the assembly 29 the planes of polarization can be adjusted from parallel for maximum light transmission to cross polarization for minimum light transmission thus providing an improvement in effective proportional dimming of the beam of light within the visible wavelengths. The combination of a set of a multiplicity of LEDs 25, each within its reflector 32 (FIG. 5) and the incandescent lamp 21 allows the synthesis of spectral energy densities in the visible wavelengths which together with the absorbing infrared filter 24 gives a composite "white" light output with low infrared content.

Figure 6:
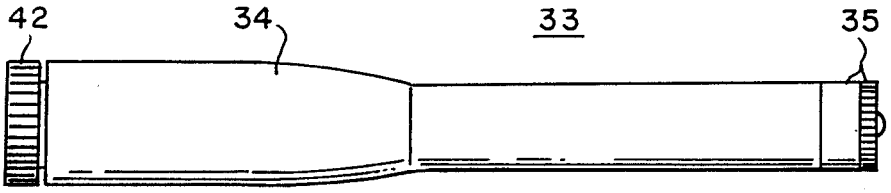
FIG. 6 is a plan view of a portable covert incandescent flashlight.
Figure 7:
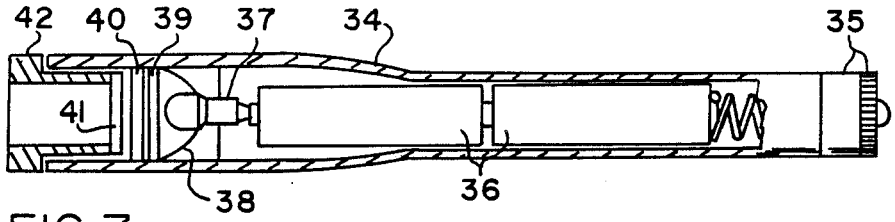
FIG. 7 is a cross section view along lines C—C of FIG. 6.
Figure 8:
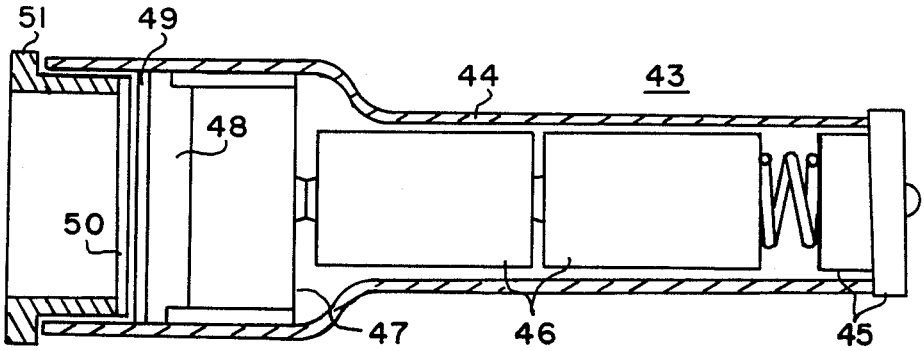
FIG. 8 is a cross section view of an electroluminescent flashlight along similar lines as C—C in FIG. 6.

FIGS. 6–8 illustrate portable embodiments of the invention. FIGS. 6–7 and FIG. 8 illustrate filtered incandescent 33 and electroluminescent 43 embodiments respectively in portable flashlight form. In FIG. 6, the incandescent lamp 37 is powered by dry cell batteries 36 through switch and rheostat 35. The lamp is supported in the reflector 38 and housing 34 which contains the infrared absorbing filter 39 and 1st polarizing filter 40 mounted therein. Within the extended hood of the housing 34 a rotatable insert 42 having the 2nd polarizing filter 41 fixed thereto is for adjustable proportional dimming of the emitted "white" light. The design and construction of the electroluminescent and power drive modules is well known in the art and is not unique to this invention. It is sufficient to note that electroluminescent lamps can emit a broad spectral "white" light as well as individual colors.

Figure 9:
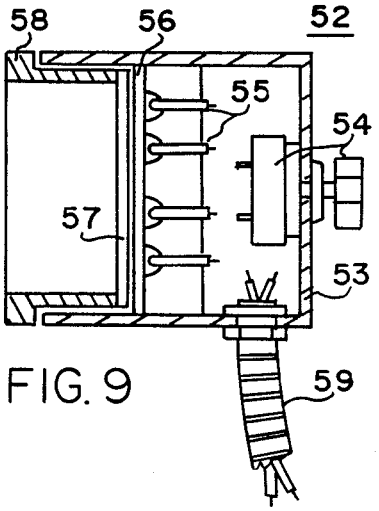
FIG. 9 is a cross section view of a light synthesizer using light emitting diodes in accordance with the invention.
Figure 10:
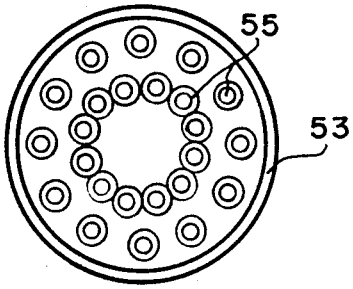
FIG. 10 is a view into the exit aperture of the synthesizer of FIG. 9 where the polarizing filters are removed.

FIGS. 9 and 10 illustrate an LED synthesizer 52 of "white" light in a housing 53 adapted for established work station applications. The projected beam of light is synthesized by a set of two or more arrays of diodes 55 selected for colored light emissions, typically red and green. Other colors and arrays may be used for synthesis of other spectral distributions. Electrical power is supplied through the flexible mounting support 59 and the momentary on switch and rheostat 54. The exit aperture of the housing contains the 1st polarizing filter 56 and the rotatable assembly 58 including the 2nd rotatable polarizing filter 57 which as before are used for adjustable degrees of dimming of the projected beam of light as the planes of polarization rotate from parallel to the orthogonal.

Figure 11:
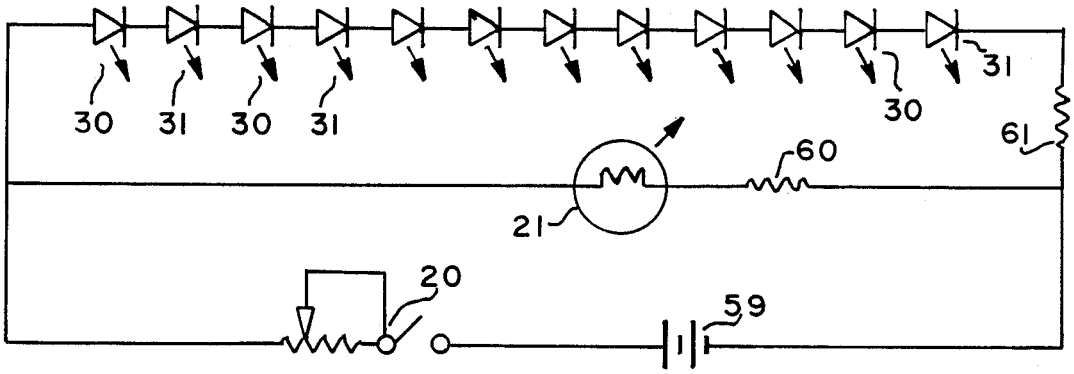
FIG. 11 is an electrical circuit diagram for the lighting device illustrated in FIGS. 2-5

A companion electrical circuit for the lighting device illustrated in FIGS. 2–5 is shown in FIG. 11. The power source 59 is typically 28 v:dc applied through switch and rheostat 20. The load consists of two branches containing the incandescent lamp 21 in series with resistor 60 in parallel with the array of red 30 and green 31 LED lamps and a limiting resistor 61.

Figure 12:
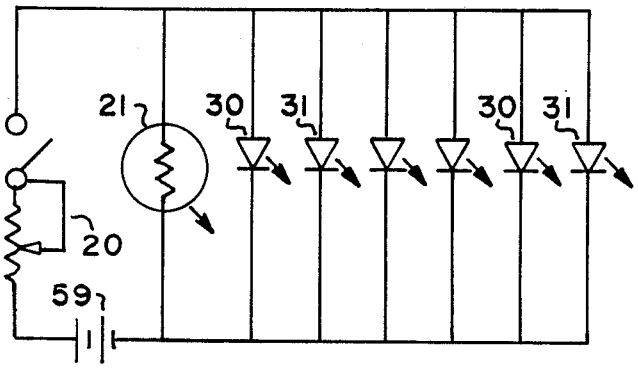
FIG. 12 is an electrical circuit diagram for the light synthesizer of FIGS. 9-10.

Portable lighting devices of the flashlight configuration typically operate at low d.c. voltages on dry cells. FIG. 12 is an electrical circuit for a "white" light synthesizer combining an incandescent lamp with an array of LEDs of the type disclosed by FIGS. 2–5. Omitting the array of diodes 30,31 the circuit applies to FIGS. 6 and 7.

Figure 13:
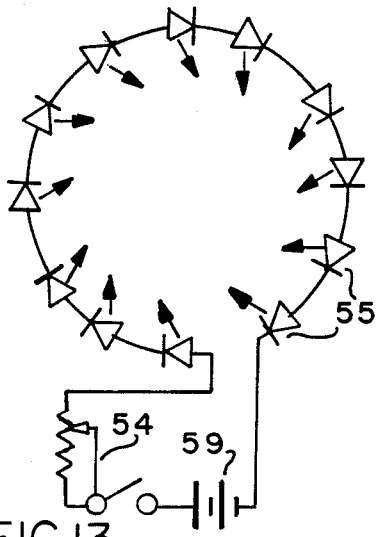
FIG. 13 is an electrical circuit diagram for the device illustrated by FIG. 9.
Figure 2:
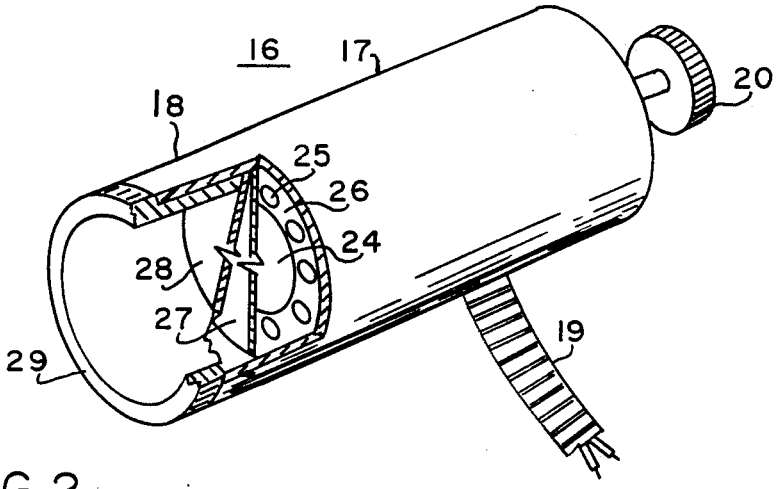
FIG. 2 is a perspective of a cockpit embodiment of the lighting device with a portion cutaway.
Figure 3:
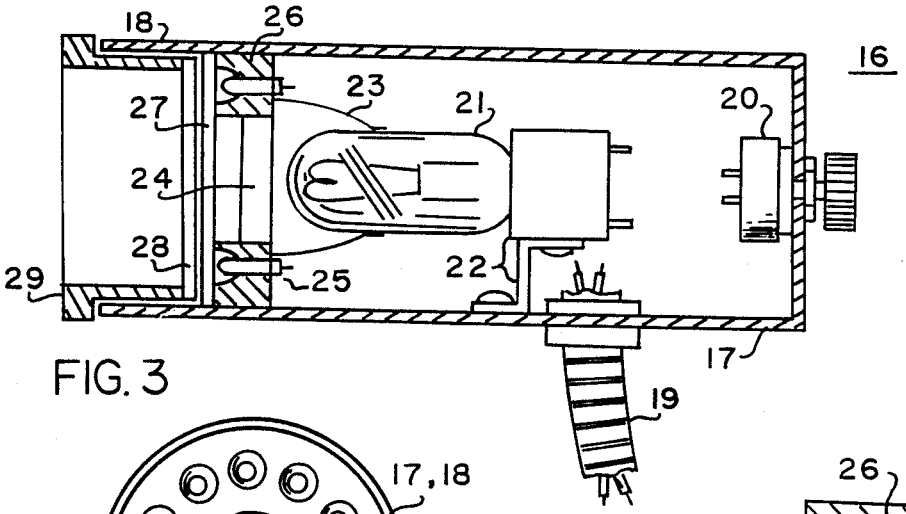
FIG. 3 is a cross section of the cockpit lighting device along lines A—A of FIG. 2.
Figure 4:
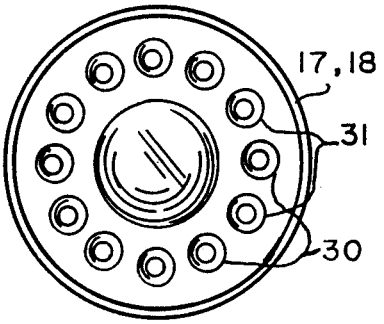
FIG. 4 is an elevation view into the exit aperture of the cockpit lamp of FIG. 2 along lines B—B of FIG. 2.
Figure 5:
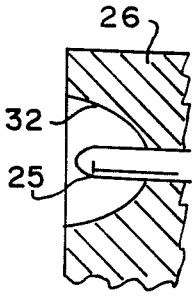
FIG. 5 is an enlarged view of a light emitting diode installation according to the invention.

FIG. 13 is an electrical circuit for the LED synthesizer illustrated in FIGS. 9–10, wherein the arrays of red and green diodes 55 are in series, supplied by d.c. power through the switch/rheostat 54. The electrical circuit for the electroluminescent portable device is seen in the mechanical illustration of FIG. 8.

Where described and illustrated as portable or mounted devices the opposite configuration may be implemented or where series or parallel electrical circuits are shown the opposite connections may be implemented if the available electrical power source so warrants. The specific drawings and descriptions are illustrative rather than limiting as to the invention.

Having described the invention, I claim

1. A lighting device for projecting radiant energy onto an on-site surface for direct viewing by the human eye of multicolored information thereon and for compatible simultaneous operation of an on-site night vision imaging system in viewing on-site as well as off-site reflectors and sources of radiant energy, said device embodied in a housing having an exit aperture for projection of said radiant energy as light and having a means for supplying electrical power responsive to a user, wherein the improvement comprises:

(a) an incandescent lamp for the emission of light in a broad band of radiant energy wavelengths;

(b) an array of electronic lamps comprising a multiplicity of light emitting diodes for the emission of light in at least one selected narrow band of radiant energy wavelengths within the visible spectrum to enhance said viewing of multicolored information, said array of electronic lamps operative simultaneously with said incandescent lamp;

(c) an optical filter for the absorption of infrared emissions of said radian energies;

(d) a rheostat, responsive to said user, for electrical dimming of said projected radiant energy by reducing the intensity levels of said incandescent and electronic lamp radiant energy emissions, said rheostat of ruse in the range of high level intensities for conserving said electrical power and reducing said absorption of infrared energies and buildup of heat in said lighting device; and (e) an optical filtering subassembly for transmission of said radiant energies and light to said exit aperture, which comprises:

at least two polarizing filters arranged for successive transmission of said radiant energies and light; and means for differential rotation of the polarization planes of said polarizing filters, responsive to said user for optical dimming of said projected radiant energy, said optical dimming for use in the range of low level intensities of said projected radiant energy for the preservation and improved stability of the color composition of said visible spectrum required for said viewing of multicolored information.

2. A lighting device for projecting radiant energy onto a multicolored on-site surface for direct viewing of information thereon by the human eye and for compatible simultaneous operation of an on-site night vision imaging system, said device embodied in a housing having an exit aperture for projection of said radiant energy and a means for supplying electrical power, wherein the improvement comprises:

(a) a first lighting subassembly, responsive to the application of said electrical power, for the emission of energy in a broad band of the visual wavelengths between 380 and 740 nanometers, forming a first spectrum of color;

(b) a second lighting subassembly, simultaneously operative with said first lighting subassembly in response to said application of electrical power, for the emission of energy in at least one selected narrow band of said visual wavelengths between 380 and 740 nanometers, forming a second spectrum of colors different from said first spectrum;

(c) means for combining and shaping said emitted broad and narrow bands of spectral energies to produce illumination for projection from said exit aperture for viewing multiple colors upon said on-site surface; and (d) an optical filter for absorbing infrared energies emitted by said first lighting subassembly at spectral wavelengths longer than 740 nanometers to establish a combined projected light having a composite total radiant energy level distributed in said visual wavelengths between 380 and 740 nanometers of at least 10 times the composite total radiant energy distributed int he wavelengths between 740 and 950 nanometers.

3. A lighting device according to claim 2 wherein the improvement further comprises a subsystem or varying the intensity of the radiant energies projected from said exit aperture, which comprises:

(a) a first polarizing filter mounted in said housing in the exit path of said projected light;

(b) a second polarizing filter mounted in said housing in said exit path of aid project light;

(c) a means for the rotation of one of said polarizing filters for the adjustment of the relative planes of polarization of said polarizing filters to effect, in combination with said absorption of infrared energy by said optical filter, variations in said intensity of projected radiant energies.

4. A lighting device as recited in claim 2, wherein aid means for combining and shaping said spectral energies within said visual wavelengths yields between 3 and 40 percent of said total visible energy between 380 and 510 nanometers plus an additional distribution of at least 20 percent of said total visible energy between 600 and 740 nanometers.

5. A lighting device as recited in claim 2 wherein said means for combining and shaping said spectral energies within said visual wavelengths yields a white light.

6. A lighting device as recited in claim 2, wherein said means for combining and shaping said spectral energies within said visual wavelengths yields at least 80 percent of the total visible energy in the wavelengths between 525 and 625 nanometers.

7. A lighting device as recited in claim 2 wherein said means for combining and shaping said spectral energies within said visual wavelengths yields a light with a balance between superior multiple color perception and improved photopic luminous efficiency for the eye.

8. A lighting device as recited in claim 2, 4, 5, 6, or 7, where said first lighting subassembly comprises:

(a) at least one incandescent lamp, responsive to the application of said electrical power.

9. A lighting device as recited in claim 2, 3, 4, 5, 6, or 7, wherein the improvement further comprises a solid state electroluminescent lamp representing said lamp, responsive to the application of said electrical power.

10. A lighting device as recited in claim 2, 4, 5, 6, or 7, wherein said second lighting subassembly comprises an array of light emitting diodes.

11. A lighting device for projection radiant energy onto a multicolored on-site surface for direct viewing of information thereon by the human eye and for compatible simultaneous operation of an on-site night vision imaging system, said device embodied in a housing having an exit aperture for said radiant energy and a means for supplying electrical power, wherein the improvement comprises:

(a) a first lighting subassembly, responsive to the application of said electrical power, for the emission of energy in a single broad band of the visual wavelengths between 380 and 740 nanometers, forming a first spectrum of colors;

(b) a second lighting subassembly, simultaneously operative with said first lighting subassembly in response to said application of electrical power, for the emission of energy in at least two selected noncoincident narrow bands of said visual wavelengths between 380 and 740 nanometers, forming a second spectrum of colors different from said first spectrum;

(c) means for combining and shaping said broad and noncoincident narrow bands of spectral energies to produce illumination for projection from said exit aperture for viewing multiple colors upon said on-site surface; and (d) an optical filter for absorbing infrared energies emitted by said first lighting subassembly at spectral wavelengths longer than 740 nanometers to establish a combined projected beam of light having a composite total radiant energy level distributed in said visual wavelengths between 380 and 740 nanometers of at least 10 times the composite total energy distributed in the wavelengths between 740 and 950 nanometers.

12. A lighting device, as recited in claim 11, which further comprises means for adjustable reduction of the intensity of said radiant energy in said projected beam of light, comprising:

(a) a first polarizing filter mounted in said housing such that said beam of light passes through said first filter;

(b) a second polarizing filter mounted in said housing such that said beam of light passes through said second filter; and (c) a means for the rotation of at least one of said first and second polarizing filters for adjusting the relative planes of polarization thereof for effecting, in combination with the absorption of said infrared energy, by said optical filter said adjustable reduction of the radiant energy in said projected beam of light.

13. A lighting device, as recited in claim 11, which further comprises means for adjustable reduction of the intensity of said radiant energy in said projected beam of light, comprising:

(a) an adjustable rheostat for limiting the electrical power applied to said lighting subassemblies to effect, in combination with the absorption of said infrared energy by said optical filter, said reduction of the intensity of said projected beam of light.

14. A lighting device as recited in claim 11, wherein said means for combining and shape said bands of spectral energies within said visual wavelengths between 380 and 740 nanometers yields at least 80 percent of said total visible energy, within the bandwidth between 525 and 625 nanometers.

15. A lighting device as recited in claim 11, wherein said means for combining and shaping said bands of spectral energies within said visual wavelengths between 380 and 740 nanometers yields a white light.

16. A lighting device as recited in claim 11, wherein said means for combining and shaping said bands of spectral energies within said visible wavelengths between said 380 and 740 nanometers, yields between 3 and 40 percent of said total visible energy between 380 and 510 nanometers, plus an additional distribution of at least 20 percent of said total visible energy between 600 and 740 nanometers.

17. A lighting device as recited in claim 11, wherein said means for combining and shaping said bands of spectral energies within said visible wavelengths yields a light comprising multiple colors in addition to ANVIS GREEN for a balance between superior multiple color perception and improved photopic luminous efficiency for the eye.

18. A lighting device as recited in claim 11, 12, 13, 14, 15, 16 or 17, wherein said set of at least two lamps comprises an array of light emitting diodes.

19. A lighting device, as recited in claim 11, 14, 15, 16, or 17, wherein the improvement further comprises:

(a) said first lighting subassembly responsive to the application of said electrical power, comprising: an incandescent lamp; and (b) said second lighting subassembly simultaneously responsive to the application of said electrical power, comprising an array of light emitting diodes operative in both of said noncoincident wavelength bands.

20. A lighting device, as recited in claim 11, 12, 13, 14, 15, 16, or 17, wherein the improvement further comprises:

said second lighting subassembly responsive to said application of electrical power, comprising:

(a) a subarray of at least one light emitting diode operable in the red portion of said wavelengths;

(b) a second subarray of at least one light emitting diode operable in the green portion of said wavelengths; and (c) means for simultaneous operation of said red and green diodes for the emission of synthesized light for visual color discrimination upon multicolor surfaces.

21. An enhancement system for the visual discrimination and direct reading by the eye of information existing in a majority of the visual colors upon an on-site working surface and for simultaneous compatible operation of an on-site night vision imaging apparatus, comprising:

(a) a lighting device, responsive to a user, which projects radiant energy in a directional beam in the visual wavelengths between 380 and 740 nanometers which totals at least 10 times the total infrared radiant energy emitted by said lighting device in the wavelengths between 740 and 950 nanometers, said lighting device comprising:

a first lighting subassembly for the radiation of energies in a broad band of wavelengths;

a second lighting subassembly for the radiation of energies in at least one narrow band of wavelengths about a selected color of the visible spectra;

a means, responsive to said user, for adjustable reduction of said radiant energies of said lighting device;

a means in said lighting device for combining different spectral distributions of energy within said visual wavelengths;

(b) a surface and working medium to be illuminated by said lighting device for viewing as required by said user; and (c) at least one image intensifier, responsive to said user and to observers, for displaying amplified radiant energies received from on-site and from external objects under nighttime conditions.

22. An enhancement system for the visual discrimination and direct reading by the eye of information existing in a majority of the visual colors upon on-site working surfaces and for simultaneous compatible operation of an on-site night vision imaging apparatus, comprising:

(a) a lighting device, responsive to a user, which projects radiant energy in a directional beam in the visual wavelengths between 380 and 740 nanometers which totals at least 10 times the total infrared radiant energy emitted by said lighting device in the wavelengths between 740 and 950 nanometers, said lighting device comprising:

a first lighting subassembly for the radiation of energies in a broad band of wavelengths;

a second lighting subassembly for the radiation of energies in at least one narrow band of wavelengths about a selected color of the visible spectra;

a means, responsive to said user, for adjustable reduction of said radiant energies of said lighting device;

means for combining different spectral distributions of energy within said visual wavelengths for a projected light comprising multiple colors in addition to ANVIS GREEN that will yield a specified balance between improved multiple color perception and superior photopic luminous efficiency for the eye;

(b) a surface and working medium to be illuminated by said lighting device for viewing as required by said user; and (c) at least one image intensifier, responsive to said user and to observers, for displaying amplified radiant energies received from on-site and from external objects under nighttime conditions.

23. An enhancement system as recited in claim 21 or 22, wherein said means for combining different spectral distributions of energy within said visual wavelengths comprises means yielding at least 80 percent of the total visible energy within wavelengths of 525 and 625 nanometers.

24. An enhancement system as recited in claim 21 or 22, wherein said means for combining different spectral distributions of energy within said visual wavelengths yields white light.

25. An enhancement system as recited in claim 21 or 22, wherein said dimming means, comprises:

(a) a filter for the absorption of energy radiations in the infrared wavelengths;

(b) a first polarizing filter interposed in said direction beam;

(c) a second polarizing filter interposed in said directional beam; and (d) means for differential rotation of said first and second polarizing filters for adjustment of their respective polarization planes from parallel to orthogonal for the reduction of the intensity of projected radiant energies of said lighting device.

* * * * *